US009747785B2

(12) United States Patent
Leale

(10) Patent No.: US 9,747,785 B2
(45) Date of Patent: Aug. 29, 2017

(54) TRANSMITTER FOR VEHICLE SUBSYSTEMS

(71) Applicant: Robert Leale, Fremdale, MI (US)

(72) Inventor: Robert Leale, Fremdale, MI (US)

( * ) Notice: Subject to any disclaimer, the term of this patent is extended or adjusted under 35 U.S.C. 154(b) by 415 days.

(21) Appl. No.: 14/066,220

(22) Filed: Oct. 29, 2013

(65) Prior Publication Data

US 2014/0121860 A1 May 1, 2014

Related U.S. Application Data

(60) Provisional application No. 61/719,767, filed on Oct. 29, 2012.

(51) Int. Cl.
*G08C 17/02* (2006.01)

(52) U.S. Cl.
CPC ..... *G08C 17/02* (2013.01)

(58) Field of Classification Search
CPC ..... G08C 17/02; B60R 16/0231; G06F 17/00; G06F 1/3203; G06F 1/3296; G07C 9/00309; G07C 2009/00317; G07C 2009/00428; G07C 2009/00492; Y02B 60/1217
See application file for complete search history.

(56) References Cited

U.S. PATENT DOCUMENTS 6,697,953 B1 * 2/2004 Collins ..... G06F 1/3203 713/320
2007/0290877 A1 * 12/2007 Kuijlaars ..... G08C 17/02 340/2.8
2009/0243796 A1 * 10/2009 Tieman ..... B60R 25/24 340/5.72
2012/0126943 A1 * 5/2012 Biondo ..... G07C 9/00182 340/5.64

* cited by examiner

*Primary Examiner* — An T Nguyen
(74) *Attorney, Agent, or Firm* — Harness, Dickey & Pierce, P.L.C.

(57) ABSTRACT

A system for remotely actuating a subsystem in a vehicle is disclosed. A transmitter is configured to transmit a signal to a receiver associated with the subsystem. The system has an associated buffer which is configured to allow the transmitter to transmit a signal to the receiver a predetermined number of times.

17 Claims, 3 Drawing Sheets

TRANSMITTER FOR VEHICLE SUBSYSTEMS

CROSS-REFERENCE TO RELATED APPLICATIONS

Figure 1:
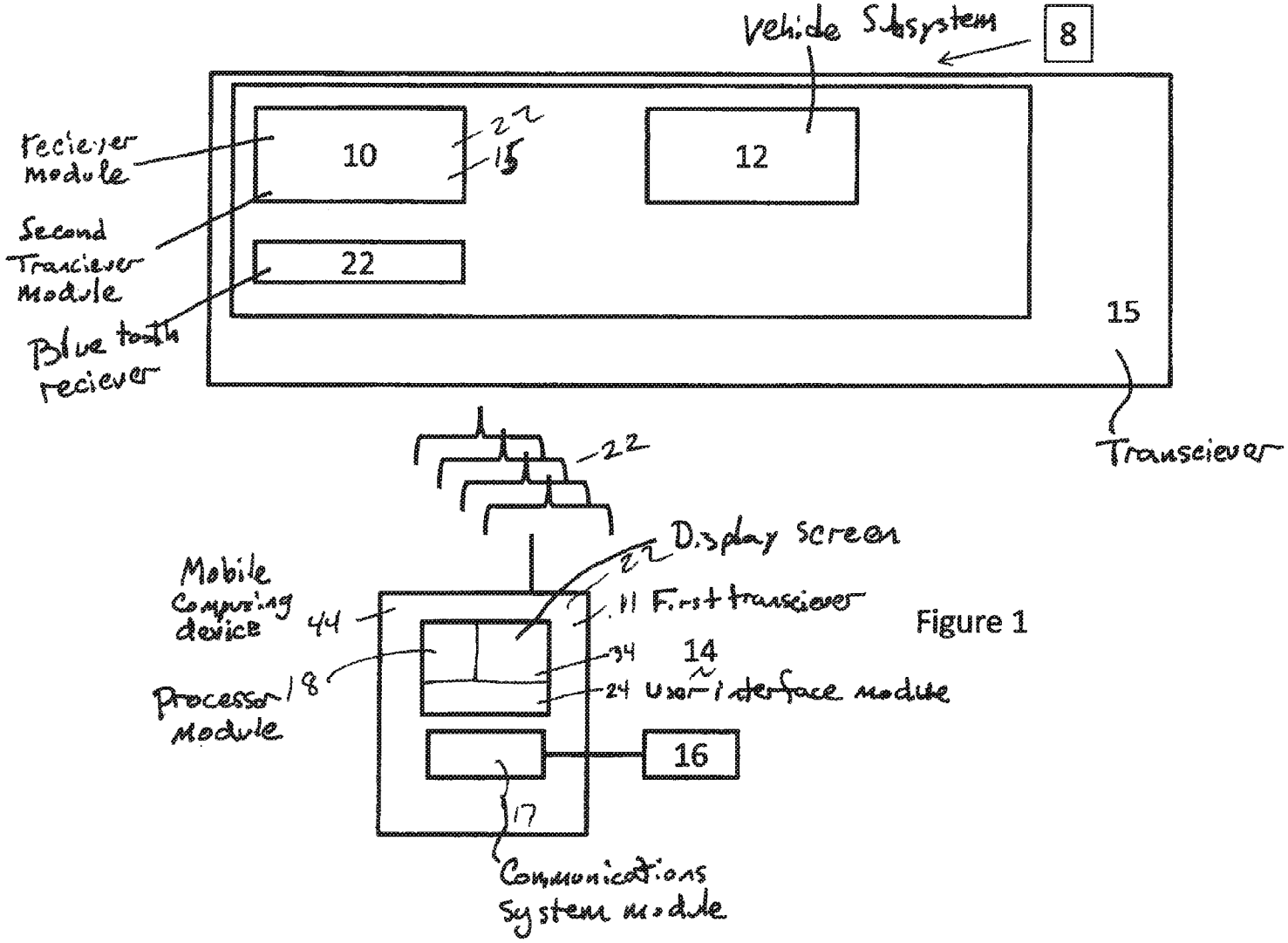

This application claims the benefit of U.S. Provisional Application No. 61/719,767, filed Oct. 29, 2012. The entire disclosure of the above application is incorporated herein by reference.

FIELD

The present disclosure relates to a transmitter and, more particularly, to a transmitter having a predetermined range used to actuate an electronic component on an automotive vehicle.

BACKGROUND

This section provides background information related to the present disclosure which is not necessarily prior art. Automobiles have been associated with an automatic transmitter, typically associated with a key fob, which allows for the actuation of, for example, a door lock, trunk or automatic vehicle remote starter. Unfortunately, these transmitters are limited in range by distance. Because of this, situations where a user has their hands encumbered, thus inhibiting the actuation of the transmitter within range of the vehicle, can be problematic.

SUMMARY

This section provides a general summary of the disclosure, and is not a comprehensive disclosure of its full scope or all of its features. To overcome the deficiencies of the prior art, a remote actuation system for a vehicle subsystem is provided. The system includes a receiver operable associated with a vehicle subsystem. A transmitter which is configured to transmit a signal to the receiver. The transmitter has an associated buffer which is configured to allow the transmitter to recursively transmit a signal to the receiver a predetermined number of times greater than one.

According to further teachings, a remote actuation system for a vehicle system is provided. The system has a radio receiver associated with a vehicle subsystem. The radio receiver being configured to receive a coded signal having a rolling code which actuates the vehicle subsystem. A transmitter having a predetermined transmission range is configured to transmit the coded signal. The transmitter has a user interface which allows a user to initiate the recursive transmission of a plurality of transmissions of the coded signals for a predetermined amount of time.

According to another teaching, the systems above can be configured to recursively transmit a remote actuation signal at predetermined intervals until a first event occurs. The first event may be, for example, the passage of a predetermined amount of time, a predetermined number of signal transmissions, or the reception of an indication the vehicle subsystem has been engaged.

According to another teaching, a vehicle subsystem is associated with a Bluetooth receiver. The Bluetooth receiver is configured to receive a coded signal to actuate the vehicle subsystem. The system further has a Bluetooth transmitter having a predetermined range and a user interface configured to recursively transmit a coded Bluetooth signal to actuate the vehicle subsystem. The Bluetooth signal can be, for instance, a system engagement signal followed by a coded instruction signal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
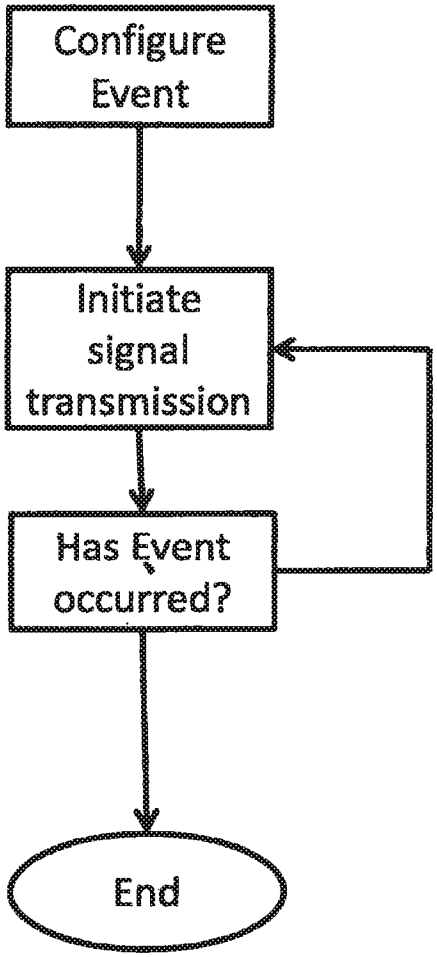
Figure 3:
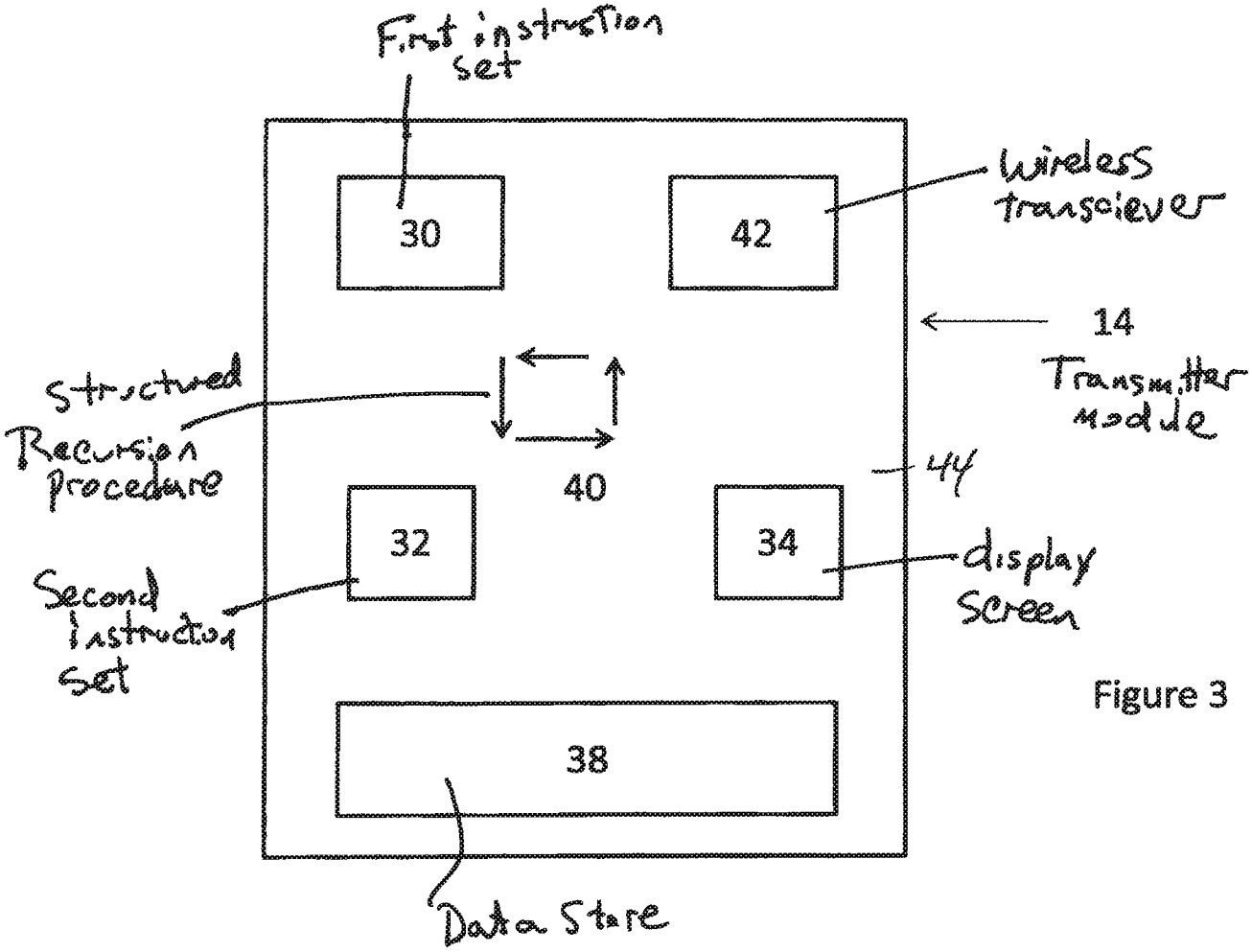

FIGS. 1-3 represent a vehicle subsystem actuation system according to the present teachings.

Corresponding reference numerals indicate corresponding parts throughout the several views of the drawings.

DETAILED DESCRIPTION

Example embodiments will now be described more fully with reference to the accompanying drawings.

The system 8 includes a receiver 10 operable associated with a vehicle subsystem module 12. A transmitter module 14 is configured to transmit a signal to the receiver module 10. The transmitter module 14 has an associated buffer module 16 which is configured to allow the transmitter module 14 to transmit a signal to the receiver module 10 a predetermined number of times.

The radio receiver module 10 is configured to receive a coded signal 20 which actuates the vehicle subsystem module 12. A transmitter module 14 (optionally a mobile computing device 44) has a predetermined transmission range and is configured to transmit the coded signal 20. The transmitter module 14 further has a user interface module 24 which allows a user to initiate the recursive transmission of a plurality of coded signals 20. The transmitter 14 further has a power evaluation module 18 configured to determine a charge state of a battery associated with the transmitter module 14. The power evaluation module is configured to produce a signal indicative of the charge state of the battery associating with the transmitter module 14.

The receiver module 10 and transmitter module 14 combination can take two configurations. In the first configuration, the transmitter module 14 is a first transceiver 11 and the receiver module 10 can be a second transceiver module 15. The first configuration functions having a triggering module which is initiated by the pressing and release of a button (button A). Upon initiation of the trigger function, the processor module 18 determines if an RF communication link is formed between the first transceiver 11 and the second transceiver module 15. If communication is formed, a Command_A is sent from the first transceiver 11 to the second transceiver module 15 using a send function. Optionally, Command_A can include a rolling code which is not changed until the button is again pressed and released. By way of example, the trigger function can be:

```
Trigger Function:
IF buttonA is Pressed then
    IF RFCommunications is Connected
        Send CommandA
    ELSE
        Que CommandA
    ENDIF
ENDIF
```

The send function can start by setting a success flag to false. The Function_Command (Command_A) is sent via an RF communications module. After waiting for a short delay, the processor module will determine if a signal is received by the first transceiver 11 from the second transceiver module 15. If indicating Command_A was received. If the signal is received, the Flag_Success Flag is set to true and returned. By way of example, the send function can be:

```
Send Function:
    Flag_Success is FALSE
    Send Function_Command via RFCommunications
    Waitfor Small_Delay
    IF CommandA_Received_by_Target then
      Flag_Success is TRUE
    ENDIF
    RETURN Flag_Success
```

If the processor determines that an RF communication connection is not formed between the first transceiver 11 and the second transceiver module 15, Command_A is transferred to the Que function. The Que function can start by setting the Flag_Success variable to false. An Event_Flag (which can be, for example, a Que timer) is set. While the Event_Flag is true, a Command_A is transmitted, and after a delay, is recursively retransmitted until the Event_Flag is set to false. If at any time, the second transceiver module 15 sends a signal indicative that it has received the Command_A signal, the Event_Flag is set to false, thus ending the recursive transmission of Command_A. By way of example, the Que function can be:

```
Que Function:
Flag_Success is False
Start Que Timer
FORLOOP Total_Durration_of_Que/Delay
Send CommandA
Waitfor Delay
IF CommandA_Received_by_Target then
    Stop Que
    Flag_Success is True
ENDIF
IF User_Cancelled_Que then
    Stop Que
ENDIF
ENDFORLOOP
Stop Que
```

The Event_Flag can be set by several occurrences. These can include, for example, the first transceiver 11 being located within a predetermined range of distances from a known or calculated location of the second transceiver module 15. In this regard, the location data from the second transceiver module 15 can be transmitted from the second transceiver module 15 to the first transceiver 11. This position data can be determined using a GPS or cell tower information.

Additionally, the Event_Flag can be set using a timer which will send Command_A from the first transceiver 11 to the second transceiver module 15 for a predetermined interval. The predetermined interval can be fixed or can be variable. The interval can be set as a function of battery charge state. For example, the processor can determine if a battery associated with the first transceiver 11 is at a high state of charge or a low state of charge. At a high state of charge, the predetermined interval can be a first length (e.g., 20 minutes); while at a low state of charge, the time interval can be shorter (e.g., 5 minutes).

Additionally, should the battery be in a low state of charge, the power associated with the transmitter 14 can be reduced. The interval between transmission can also vary as time passes. For example, for the first few minutes of interval, a Command_A signal can be transmitted every 0.5 seconds. After several minutes, the Command_A signal can be transmitted once every two or three seconds to save battery power.

According to another teaching, a vehicle subsystem is associated with transceiver 11 and 15 associated with a Bluetooth receiver module 22. The Bluetooth receiver module 22 is configured to receive a codes signal to actuate the vehicle subsystem module 12. The transmitter module 14 is a Bluetooth transmitter having a predetermined range and a user interface configured to recursively transmit a coded Bluetooth signal to actuate the vehicle subsystem 8. The Bluetooth signal 20 can be, for instance, a system engagement signal followed by a coded instruction signal which initiates the vehicle subsystem module 12.

In the second configuration, the receiver module 10, which can be associated with a vehicle or other subsystem such as a garage door, is configured to receive commands (Command_A) from the transmitter module 14. The second configuration functions having a triggering module which is initiated by pressing and releasing of a button (button A). Upon initiation of the triggering function, the processor module 18 initiates the send function which recursively sends the command signal (Command_A). As described above, the command signal can be transmitted for a predetermined amount of time. This time interval can be of a fixed duration, or can be a function of a battery charge associated with a transmitter battery. It is envisioned in a mono-transmitter configuration that the command signal will include a rolling code which will remain unchanged and be transmitted through the interval, or until the button is pressed and released a second time.

As shown in FIG. 2, the system 8 can be configured to recursively transmit a remote actuation signal 20 at predetermined intervals until a first event occurs. The first event may be, for example, the passage of a predetermined amount of time, a predetermined number of signal transmissions, or the reception of an indication the vehicle subsystem has been engaged.

As shown generally in FIGS. 1-3, the system for remotely actuating a vehicle subsystem module 8 according to the present teachings provides a hand held transmitter module 14 which can be a mobile phone or computing device capable of allowing manual entry and storage of vehicle subsystem parameters to be actuated. The vehicle subsystem module 8 can be automatically inputted into the transmitter module 14 using applicable systems. A system for managing the transmission of a signal also provides for a communications system module 17 to allow the transfer of coded signal through the transmitter.

A first instruction set 30 within the mobile computing device module 44 functions to support functionality not directly associated with the wireless communication related to the vehicle subsystem, while a second instruction set 32 within the mobile device module 44 functions to support the functionality related to communicating the coded signal through the communications system. The first instruction set 30 supports functionality which can be, for instance, data entry, reminders, the prompting of structured data configuration procedures, and simple reporting through a display screen 34.

The mobile computing device 44 through the second instruction set 32 is configured to communicate coded signal through mobile environments such as a wireless system to transfer the coded signal. Optionally, the communications system can transfer the data using protocols AC360 DMS web and blue tooth protocol. In addition to the manual entry of data, automatically update subsystem information into the mobile computing device 44. Optionally, additional vehicle related subsystem information from databases can be uploaded to the mobile computing device 44. This information can be updated and incorporated through the wireless system into the mobile computing device 44 as a software update. These datasets can, for example, include location information, additional structured protocols, and database information.

As shown in FIGS. 1 and 2, the mobile computing device 44 has a data input module 36 such as a keyboard. As is known, the data input mechanism 24 can be integrated into the display screen 34. Optionally, the display screen 34 will prompt the user to input subsystem factors such as vehicle location. The user has the ability to vary the value of the units for the vehicle being inputted.

At various times, as described in detail below, the mobile computing device 44 can prompt the user to input transmission information. These can be a single one dimensional implemented input. The mobile computing device 44 can supply default implemented codes which can vary based on a geographic region of the world or based on international standards. In addition to prompting a user for locational measurements for calibration, the mobile computing device 44 allows for the user to input other information which may be useful to a subsystem. This information can, for example, include measures of subsystem quality control, a vehicle location, and a physiological state of the signals. The mobile computing device 44, through the display, can additionally allow the user to configure the mechanism so that reminders can occur. For instance, audible or vibrating reminders can occur. The inputted value should be checked to determine if it is within an acceptable level.

As best seen in FIG. 3, a representative mobile computing device 44 has a display screen 34, data entry interface and log. The data entry interface is configured to receive codes for the user and store the codes in the log. An associated data store 38 stores a plurality of structured collection procedures. As described below, each structured recursion procedure 40 specifies one or more recursion events for obtaining codes from the user.

The mobile computing device 44 further has a processor having a selection module that operates selectively to analyze the coded signal such as codes in the log and select and present to the user, through alarms and prompting, a given structured recursion procedure 40. An administrative module 50 in data communication module with the data store 38 prompts the user to input codes into the data entry interface in accordance with the structured recursion procedure 40. A wireless transceiver 42 is coupled to an administrative module 50 and is configured to transmit data from the log to a subsystem through the wireless network.

A data analysis module associated with the administrative module selectively operates to analyze the codes in the log and interface with the transceiver to transmit the data from the log to a subsystem when the coded signal is outside of a predetermined window. Additionally, coded signal can be transmitted at predetermined time intervals, when a predetermined number of samples are collected or as requested by a subsystem. Upon detecting certain events such as a low battery, the administrative module may prompt a user to engage in a more rigorous structured recursion procedure 40 or may request further data related to subsystem logistics events. This may occur if, for instance, the package location or delivery time in the log is trending in an undesirable direction.

As is shown in FIG. 3, the mobile computing device 44 allows for the manual or automatic prompting of one of several structured data configuration regimes or recursion procedures 40 as required by a subsystem such as time intervals or GPS locator. Additionally, an indication that a structured data configuration regime is running as well as its progress can be visible on the display screen. It is envisioned that at least two structured recursion procedures can be available. The first is a structured data configuration. During the structured data configuration, the mobile computing device 44 will prompt the user at each signal transfer to enter information related to the signal transfer as well as power energy levels.

The Bluetooth receiver can be, for example, coupled into a vehicle interface connector. The connector is coupled to the various ECU's associated with various vehicle subsystem modules. These subsystems can be, for instance, a door/trunk lock subsystem, an ignition subsystem, or an alarm subsystem. Optionally, the Bluetooth receiver can have an associated transmitter which can send a signal to the hand held transmitter 44 to signal a properly received signal.

As used herein, the term module may refer to, be part of, or include an Application Specific Integrated Circuit (ASIC); an electronic circuit; a combinational logic circuit; a field programmable gate array (FPGA); a processor (shared, dedicated, or group) that executes code; other suitable hardware components that provide the described functionality; or a combination of some or all of the above, such as in a system-on-chip. The term module may include memory (shared, dedicated, or group) that stores code executed by the processor.

The term code, as used above, may include software, firmware, and/or microcode, and may refer to programs, routines, functions, classes, and/or objects. The term shared, as used above, means that some or all code from modules may be executed using a single (shared) processor. In addition, some or all code from modules may be stored by a single (shared) memory. The term group, as used above, means that some or all code from a single module may be executed using a group of processors. In addition, some or all code from a single module may be stored using a group of memories.

The apparatuses and methods described herein may be implemented by one or more computer programs executed by one or more processors. The computer programs include processor-executable instructions that are stored on a non-transitory tangible computer readable medium. The computer programs may also include stored data. Non-limiting examples of the non-transitory tangible computer readable medium are nonvolatile memory, magnetic storage, and optical storage.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for remotely actuating a subsystem in a vehicle comprising:

a receiver operable associated with a vehicle system; and a transmitter which is configured to transmit a control signal readable by the receiver, the transmitter having an associated processor which is configured to allow the transmitter to transmit the control signal to the receiver a predetermined number of times at a first predetermined power level and having a first predetermined delay between transmissions of the control signal, wherein the system comprises a power evaluation module configured to determine a charge state of a battery associated with the transmitter, the power evaluation module being configured to produce a signal indicative of the charge state of the battery associated with the transmitter and change the output of the transmitter from the first predetermined power level to a second predetermined power level in response to the signal indicative of the charge state of the battery, and change an interval between transmission of the control signal readable by the receiver is can be set as a function of battery charge state;

wherein the processor is configured to change the delay between transmissions of the control signal of the transmitter from the first predetermined delay between transmissions of the control signal to a second predetermined delay between transmissions of the control signal in response to the signal indicative of the charge state of the battery, and the transmitter is configured to recursively transmit the control signal for a predetermined amount of time at predetermined intervals.

2. The system according to claim 1, wherein the predetermined amount of time is a function of the signal indicative of the charge state.

3. The system according to claim 1, wherein an interval associated with the transmitter is a function of the signal indicative of the charge state.

4. The system according to claim 1, wherein the transmitter is configured to transmit the control signals at intervals which vary with time.

5. A system for remotely actuating an electrical subsystem, the system comprising:

a first transceiver module associated with a mobile computing device;

a second transceiver module operably coupled to the electrical subsystem, wherein the first transceiver module is configured to recursively transmit a first command signal until one of the passage of a predetermined time interval and the reception of a second signal from the second transceiver module, said second transceiver module configured to provide a third signal in response to receiving the first command signal, the first transceiver having an associated processor which is configured to allow the first transceiver to transmit the control signal to the second transceiver a predetermined number of times at a first predetermined power level and having a first predetermined delay between transmissions of the control signal, wherein the processor comprises a power evaluation module configured to determine a charge state of a battery associated with the transceiver, the power evaluation module being configured to produce a signal indicative of the charge state of the battery associated with the first transceiver and change the delay between transmissions of the control signal of the first transceiver from the first predetermined delay between transmissions of the control signal to a second predetermined delay between transmissions of the control signal in response to the signal indicative of the charge state of the battery.

6. The system according to claim 5, wherein the third signal is configured to control the electrical subsystem.

7. The system according to claim 5, wherein the second signal is the third signal.

8. The system according to claim 5, wherein the electrical subsystem is a vehicle subsystem.

9. The system according to claim 5, further comprising a power analysis module configured to assess the charge state of a battery associated with the first transceiver.

10. The system according to claim 9, wherein the power analysis module is configured to provide a fourth signal indicative of a charge state of the battery.

11. The system according to claim 10, wherein the length of the predetermined time interval is a function of the fourth signal.

12. A system for remotely actuating a subsystem comprising:

a first transceiver module configured to recursively transmit a control signal having a first rolling code until one of a predetermined amount of time at predetermined intervals and the reception of a second signal the first transceiver having an associated processor which is configured to allow the first transceiver to transmit the control signal to the second transceiver a predetermined number of times at a first predetermined power level and having a first predetermined delay between transmissions of the control signal, wherein the system comprises a power evaluation module configured to determine a charge state of a battery associated with the first transceiver, the power evaluation module being configured to produce a signal indicative of the charge state of the battery associated with the first transceiver and change the output of the first transceiver for the first rolling code from the first predetermined power level to a second predetermined power level for the first rolling code in response to the signal indicative of the charge state of the battery, and the processor being configured to change the delay between transmissions of the control signal of the first transceiver from the first predetermined delay between transmissions of the control signal to a second predetermined delay between transmissions of the control signal in response to the signal indicative of the charge state of the battery; and a second transceiver module configured to receive the control signal and transmit the second signal upon receipt of the control signal, said second transceiver module configured to produce a third signal configured to control the subsystem.

13. The system according to claim 12, further comprising a push button actively coupled to the first transceiver module.

14. The system according to claim 13, wherein the first transceiver transmits a first control signal having the first rolling code upon a first activation the button, and the first transceiver transmits a second control signal having a second rolling code upon a second actuation of the button.

15. The system according to claim 12, wherein the subsystem is a vehicle subsystem.

16. The system according to claim 12, wherein the first transceiver module is configured to recursively transmit the control signal at varying intervals.

17. The system according to claim 12, wherein the first transceiver is configured to transmit the control signal at varying power levels.

* * * * *